US010770219B2

(12) United States Patent
Kawasaki et al.

(10) Patent No.: US 10,770,219 B2
(45) Date of Patent: Sep. 8, 2020

(54) COIL COMPONENT

(71) Applicant: TDK Corporation, Tokyo (JP)

(72) Inventors: Yoshihiro Kawasaki, Tokyo (JP); Kouyu Ohi, Yamagata (JP); Hirohumi Asou, Tokyo (JP); Syun Ashizawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 393 days.

(21) Appl. No.: 15/848,618

(22) Filed: Dec. 20, 2017

(65) Prior Publication Data

US 2019/0189331 A1 Jun. 20, 2019

(51) Int. Cl.

| | |
|---|---|
| ***H01F 27/30*** | (2006.01) |
| ***H01F 27/255*** | (2006.01) |
| ***H01F 27/29*** | (2006.01) |
| ***H01F 27/28*** | (2006.01) |
| ***H01F 27/26*** | (2006.01) |
| ***H01F 5/00*** | (2006.01) |

(52) U.S. Cl.

CPC ..... *H01F 27/255* (2013.01); *H01F 5/00* (2013.01); *H01F 27/263* (2013.01); *H01F 27/28* (2013.01); *H01F 27/2823* (2013.01); *H01F 27/292* (2013.01); *H01F 27/30* (2013.01)

(58) Field of Classification Search

CPC .... H01F 5/00; H01F 27/00–40; H01F 27/255; H01F 27/263; H01F 27/2823; H01F 27/292

USPC ... 336/65, 83, 192, 196, 198, 200, 206–208, 336/210–211, 232

See application file for complete search history.

(56) References Cited

U.S. PATENT DOCUMENTS

| | | | | |
|---|---|---|---|---|
| 6,242,996 | B1 * | 6/2001 | Sato | H01F 17/045 336/174 |
| 6,373,366 | B1 * | 4/2002 | Sato | H01F 17/045 336/192 |
| 8,975,993 | B2 * | 3/2015 | Tomonari | H01F 27/292 336/192 |
| 2003/0071704 | A1 * | 4/2003 | Toi | H01F 17/045 336/83 |
| 2006/0158804 | A1 | 7/2006 | Usui et al. | |
| 2017/0229228 | A1 | 8/2017 | Kawasaki et al. | |

(Continued)

FOREIGN PATENT DOCUMENTS

| | | | |
|---|---|---|---|
| JP | H9-219318 | A | 8/1997 |
| JP | 2004-363178 | A | 12/2004 |
| JP | 2017-143119 | A | 8/2017 |

(Continued)

*Primary Examiner* — Tuyen T Nguyen

(74) *Attorney, Agent, or Firm* — Young Law Firm, P.C.

(57) ABSTRACT

Disclosed herein is a coil component that includes a drum core having a winding core part and first and second flange parts provided on both sides of the winding core part; a wire wound around the winding core part; a plurality of terminal electrodes connected with end portions of the wire, each of the terminal electrodes being provided on an associated one of the first and second flange parts; and a top plate fixed to the first and second flange parts. The top plate includes a magnetic layer comprising magnetic powder and binder resin, and a resin layer having a smaller content of the magnetic powder than that of the magnetic layer. The resin layer is positioned between the first and second flange parts and the magnetic layer.

14 Claims, 7 Drawing Sheets

(56) References Cited

U.S. PATENT DOCUMENTS

| | | | |
|---|---|---|---|
| 2017/0229229 | A1 | 8/2017 | Kawasaki et al. |
| 2017/0229230 | A1 | 8/2017 | Kawasaki et al. |

FOREIGN PATENT DOCUMENTS

| | | | | | |
|---|---|---|---|---|---|
| JP | 2017-143120 | A | | 8/2017 | |
| JP | 2017-143121 | A | | 8/2017 | |
| JP | 2017143121 | A | * | 8/2017 | ..... H01F 3/10 |

* cited by examiner

COIL COMPONENT

BACKGROUND OF THE INVENTION

Field of the Invention

The present invention relates to a coil component, and more particularly relates to a coil component using a drum core.

Description of Related Art

A coil component using a drum core can be surface-mounted on a printed circuit board differently from a coil component using a toroidal core, and thus has been widely used for mobile electronic devices such as a smartphone. Further, because the coil component using a drum core has a low height, it also contributes to thinning of mobile electronic devices.

However, in recent years, further thinning of mobile electronic devices has been desired, and in order to realize this, a further lower height has been desired for the coil component using a drum core. As one method of realizing a low height of a coil component, a method in which a magnetic top plate generally bonded to a drum core is omitted can be considered. However, in this case, because leakage of the magnetic flux increases, other circuits such as an antenna may be adversely affected. Meanwhile, because a magnetic top plate made of ferrite is fragile, if the thickness thereof is reduced, its strength becomes insufficient, and thus the magnetic top plate may be broken at the time of assembly or at the time of actual use.

To solve the above problems, it suffices to use magnetic-powder containing resin having flexibility instead of using ferrite as a material of the magnetic top plate. The magnetic-powder containing resin can maintain certain strength even if it is thinned. Therefore, by using the magnetic-powder containing resin as the material of the magnetic top plate, leakage of the magnetic flux can be suppressed while realizing a low height. As an example of using magnetic-powder containing resin as a material of a magnetic top plate, coil components described in Japanese Patent Application Laid-open No. H9-219318 and Japanese Patent Application Laid-open No. 2004-363178 can be mentioned.

However, magnetic powder contained in the magnetic-powder containing resin often has conductivity, which may cause a short circuit failure between itself and a terminal electrode or a wire. Further, the magnetic-powder containing resin has a larger thermal expansion coefficient than that of the drum core, and this causes the peel-off of the resin from the drum core due to a temperature change.

SUMMARY

It is therefore an object of the present invention to provide a coil component using a top plate containing the magnetic-powder containing resin, capable of making a short circuit failure and peel-off of the top plate less likely to occur while reducing the height.

A coil component according to the present invention includes a drum core having a winding core part and first and second flange parts provided on both sides of the winding core part; a wire wound around the winding core part; a plurality of terminal electrodes connected with end portions of the wire, each of the terminal electrodes being provided on an associated one of the first and second flange parts; and a top plate fixed to the first and second flange parts, wherein the top plate includes: a magnetic layer comprising magnetic powder and binder resin; and a resin layer having a smaller content of the magnetic powder than that of the magnetic layer, and wherein the resin layer is positioned between the first and second flange parts and the magnetic layer.

According to the present invention, the resin layer is interposed between the first and second flange parts and the magnetic layer, so that it is possible to prevent occurrence of a short circuit failure between the magnetic layer and the terminal electrode or wire. Further, by using a material having a thermal expansion coefficient falling between the thermal expansion coefficient of the magnetic layer and that of the drum core, it is possible to prevent peel-off of the top plate due to a temperature change. Further, mechanical strength of the top plate can be enhanced by the resin layer.

In the present invention, it is preferable that the resin layer does not substantially include the magnetic powder. This makes it possible to more reliably prevent occurrence of a short circuit failure.

In the present invention, it is preferable that the resin layer includes non-magnetic filler. This makes it possible to adjust the thermal expansion coefficient to a desired value.

In the present invention, the resin layer may cover the entire surface of the magnetic layer or may be selectively provided between the first and second flange parts and the magnetic layer. According to the former, it is possible to reduce the manufacturing cost of the top plate and reliably prevent a short circuit failure. According to the latter, it is possible to more reliably prevent peel-off of the top plate due to a temperature change.

The coil component according to the present invention preferably further includes an adhesive for bonding the first and second flange parts and the resin layer of the top plate. With this configuration, insulation effect by the adhesive can also be expected.

In the present invention, it is preferable that the magnetic layer of the top plate has a lower surface facing the resin layer and an upper surface positioned on the side opposite to the lower surface and that the density of the binder resin is higher at a surface layer part on the upper surface side than at a surface layer part on the lower surface side. This improves the insulation property of the upper surface of the top plate. This prevents occurrence of a short circuit failure due to contact between the upper surface of the top plate and another electronic component, making it possible to obtain a highly reliable coil component. In addition, the density of the magnetic powder is high at the surface layer part on the lower surface side of the magnetic layer, so that a magnetic path passing through the top plate is shortened, which makes it possible to obtain high magnetic characteristics.

In the present invention, it is preferable that the magnetic powder is soft magnetic metal powder. Accordingly, high magnetic properties can be obtained. Particularly, it is preferable that the soft magnetic metal powder has a flat shape. Accordingly, higher magnetic properties can be obtained.

According to the present invention, there can be provided a coil component capable of making a short circuit failure and peel-off of the top plate less likely to occur while reducing the height.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

First Embodiment

Figure 1:
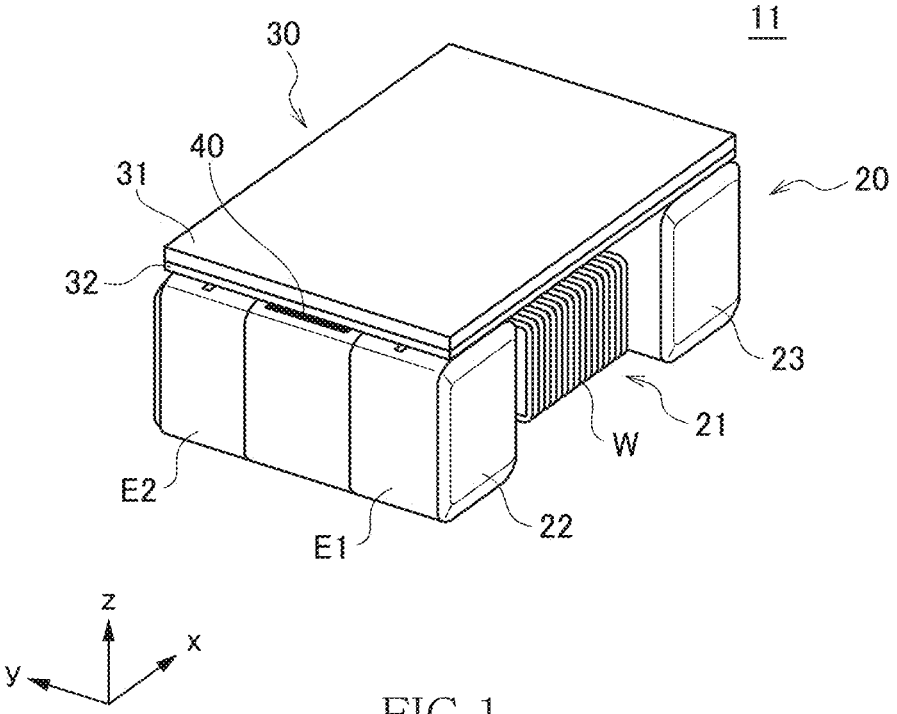
FIG. 1 is a perspective view of a coil component according to a first embodiment of the present invention when an upper surface thereof is viewed from an oblique direction.
Figure 2:
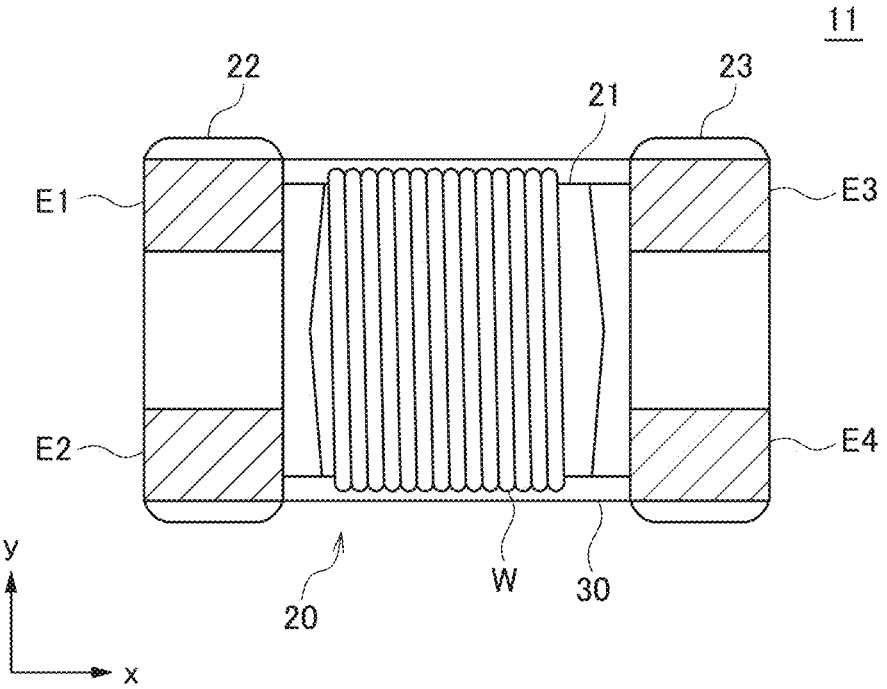
FIG. 2 is a plan view of the coil component according to the first embodiment of the present invention as viewed from a mounting surface.
Figure 3:
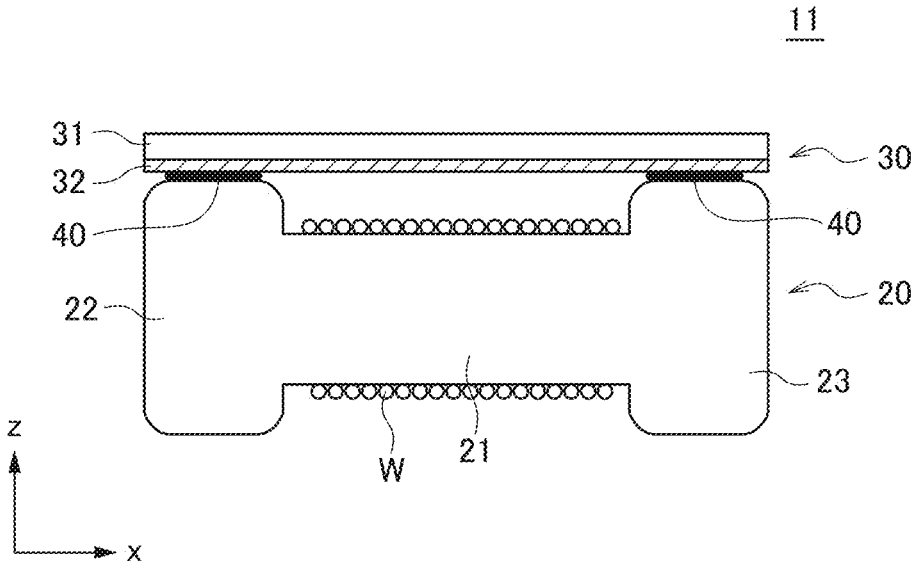
FIG. 3 is a sectional view of the coil component according to the first embodiment of the present invention.

FIGS. 1 to 3 are diagrams showing an appearance of a coil component 11 according to the first embodiment of the present invention. FIG. 1 is a perspective view of the coil component 11 when an upper surface thereof is viewed from an oblique direction, FIG. 2 is a plan view thereof as viewed from a mounting surface, and FIG. 3 is a sectional view thereof.

As shown in FIGS. 1 to 3, the coil component 11 according to the first embodiment includes a drum core 20 and a top plate 30. The drum core 20 has a winding core 21 with an x direction being an axial direction, and first and second flange portions 22 and 23 provided at opposite ends of the winding core 21 in the x direction. The drum core 20 is made of a ceramic material having high magnetic permeability such as ferrite, and has a configuration in which the winding core 21 and the flange portions 22 and 23 are integrally formed.

Two wires W are wound around the winding core 21, and opposite ends of these wires W are respectively connected to terminal electrodes E1 to E4 provided in the flange portions 22 and 23. In the present embodiment, the terminal electrodes E1 and E2 are formed in one flange portion 22, and the terminal electrodes E3 and E4 are formed in the other flange portion 23. The terminal electrodes E1 to E4 are formed continuously on an xy plane of the flange portions 22 and 23 constituting a mounting surface, an xy plane of the flange portions 22 and 23 located opposite to the mounting surface and constituting an upper surface, and yz planes of the flange portions 22 and constituting outer side surfaces. In the present embodiment, the wires W are respectively connected to the terminal electrodes E1 to E4 provided on the upper surfaces of the flange portions 22 and 23; however, the wires W can be connected to the terminal electrodes E1 to E4 provided on the mounting surfaces of the flange portions 22 and 23. In this case, the terminal electrodes E1 to E4 do not need to be provided on the upper surfaces of the flange portions 22 and 23.

The application of the coil component 11 according to the present embodiment is not particularly limited to any type, and can be a general-purpose coil component for inductance, or can be a coil component for a specific application, for example, for a common-mode filter, for a pulse transformer, or for a balun transformer. Therefore, the number of wires W wound around the winding core 21, the number of windings, the winding direction, and the winding method are not particularly limited to any specific number. The size of the coil component 11 is not particularly limited to any specific size. However, the length in the x direction is about 1.6 millimeters, the width in a y direction is about 1.0 millimeter, and the height in a z direction is from about 0.55 millimeter to about 0.65 millimeter.

Figure 4:
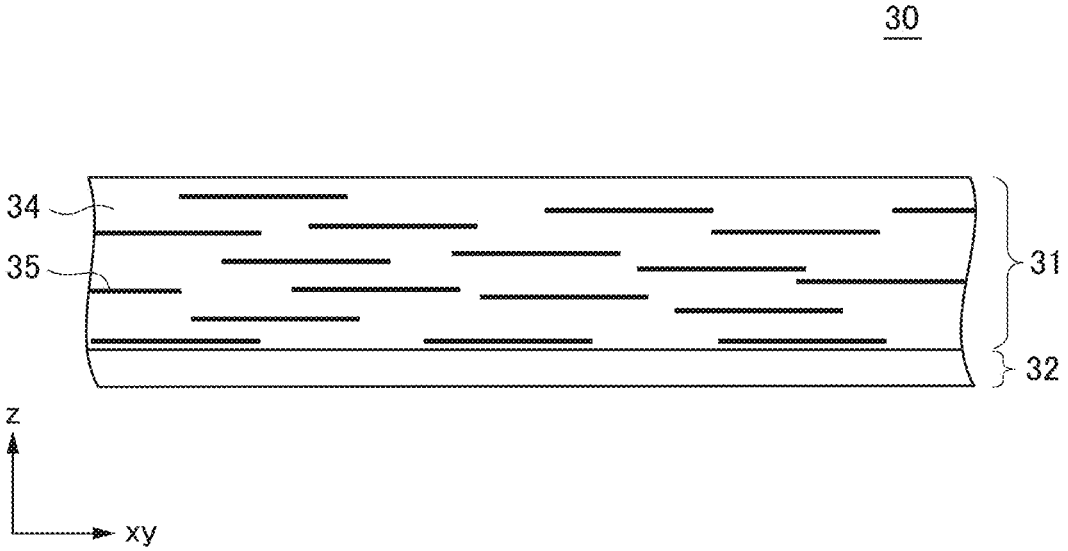
FIG. 4 is an explanatory schematic sectional view of the structure of a top plate.

As illustrated in FIGS. 1 and 3, the top plate 30 is fixed to the xy plane constituting the upper surfaces of the flange parts 22 and 23 through an adhesive 40. As illustrated in FIG. 4, the top plate 30 has a laminated structure of a magnetic layer 31 (upside) and a resin layer 32 (downside). That is, the resin layer 32 is positioned between the flange parts 22, 23 and the magnetic layer 31.

The magnetic layer 31 is made of magnetic-powder containing resin obtained by mixing magnetic powder 35 in binder resin 34, and has higher magnetic permeability than general resin. Because the top plate 30 having the magnetic layer 31 is fixed on the upper surfaces of the flange portions 22 and 23 so as to span the wiring core 21, the drum core 20 and the magnetic layer 31 constitute a closed magnetic path. Therefore, as compared to a case where a top plate made of only resin is used, leakage of the magnetic flux decreases, and magnetic impact on other circuits, for example, on an antenna circuit can be reduced. Further, the top plate 30 is also used as an adsorption face for handling at the time of mounting on a printed circuit board.

Figure 5:
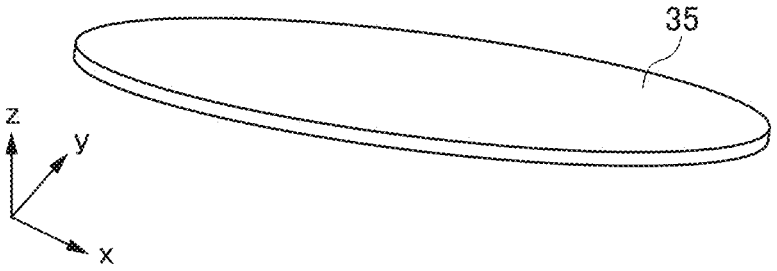
FIG. 5 is an explanatory schematic diagram of the shape of a magnetic powder contained in the top plate.

As described above, the magnetic-powder containing resin constituting the magnetic layer 31 is obtained by mixing magnetic powder 35 in binder resin 34. The binder resin 34 preferably has a cross-linked structure by urethane bond, with acrylic ester copolymer being a main chain. Meanwhile, it is preferable to use soft magnetic metal powder having a flat shape in an xy plane for the magnetic powder 35 as shown in FIG. 5. When soft magnetic metal powder having a flat shape is used, it is preferable to mix the soft magnetic metal powder in the binder resin 34 so that a principal plane of the soft magnetic metal powder becomes the xy plane. Accordingly, the magnetic permeability in the x direction, being a direction of the magnetic flux passing the magnetic layer 31, can be increased, and the soft magnetic metal powder having a flat shape also functions as an electromagnetic shield.

The resin layer 32 plays a role of preventing direct contact between the flange parts 22, 23 and the magnetic layer 31 by being interposed therebetween. The magnetic powder 35 contained in the magnetic layer 31 has conductivity, and this magnetic layer 31 may be exposed from the binder resin 34, and thus the resin layer 32 needs to be interposed. An insulating resin material similar to that of the binder resin 34 can be used as a material for the resin layer 32. Using the resin layer 32 made of such an insulating resin material significantly improves dielectric strength between the magnetic layer 31 and the terminal electrodes E1 to E4 or wire W, thereby making it possible to prevent a short circuit failure from occurring therebetween. Further, the resin layer 32 functions as a cushioning material, thereby improving impact resistance.

Magnetic or non-magnetic filler may be added to the resin layer 32. However, an excessively large content of the magnetic powder may deteriorate an insulating property, so that when the magnetic powder is added to the resin layer 32, the content of the magnetic powder needs to be less than that in the magnetic layer 31. On the other hand, the non-magnetic filler can be added for controlling physical characteristics such as a thermal expansion coefficient. When the thermal expansion coefficient of the resin layer 32 is adjusted to a value between the thermal expansion coefficient of the magnetic layer 31 and that of the drum core 20 by addition of the non-magnetic filler, it is possible to prevent peel-off of the top plate 30 due to a temperature change. Examples of the non-magnetic filler include, e.g., talc and mica.

As described above, in the coil component 11 according to the present embodiment, the top plate 30 fixed to the drum core 20 has a laminated structure of the magnetic layer 31 and resin layer 32, and the resin layer 32 is interposed between the drum core 20 and the magnetic layer 31, so that it is possible to improve dielectric strength, impact resistance, peeling strength, and the like while reducing the height.

Figure 6:
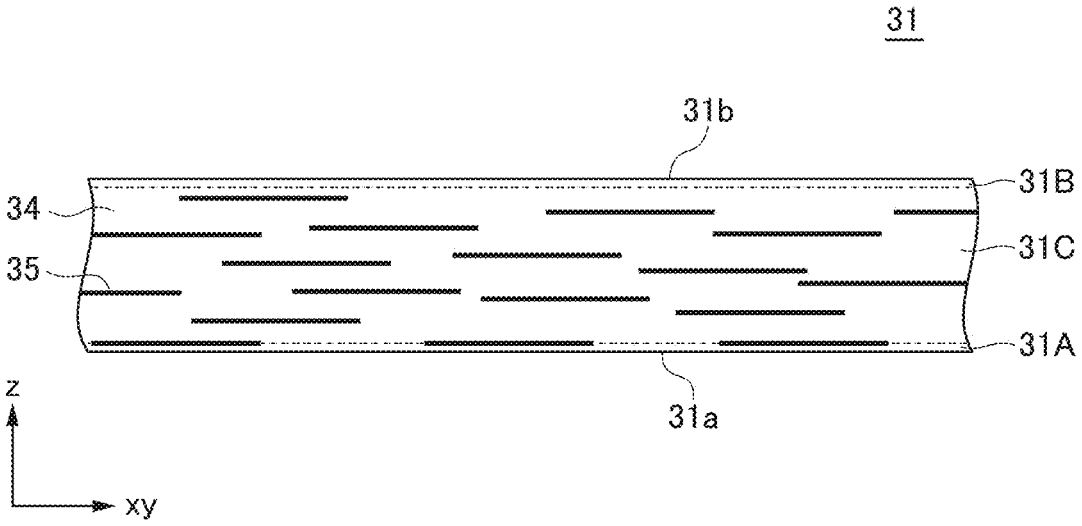
FIG. 6 is an explanatory schematic sectional view of the structure of a magnetic layer.

FIG. 6 is an explanatory schematic sectional view of the structure of the magnetic layer 31.

As shown in FIG. 6, in the magnetic layer 31, distribution of the binder resin 34 and the magnetic powder 35 in the thickness direction (the z direction) is not completely uniform, and particularly, a surface layer part 31A and a surface layer part 31B may have different characteristics from each other.

Specifically, in an inner layer part 31C of the magnetic layer 31, the soft magnetic metal powder 35 is distributed substantially uniformly in the binder resin 34. Meanwhile, in the surface layer part 31B, the density of the magnetic powder 35 is lower than that in the inner layer part 31C, and the density of the binder resin 34 is higher than that in the inner layer part 31C. As a result, there is less magnetic powder 35 exposed on the surface 31*b*, and typically, the magnetic powder 35 is hardly exposed on the surface 31*b*. In this case, substantially the entire surface of the surface 31*b* is covered with the binder resin 34. On the other hand, a configuration of the surface layer part 31A is substantially identical to that of the inner layer part 31C. That is, in the surface layer part 31A, the density of the magnetic powder 35 in the binder resin 34 is substantially the same as that in the inner layer part 31C. Therefore, the magnetic powder 35 may be exposed to some extent from the surface 31*a*.

Figure 7A:
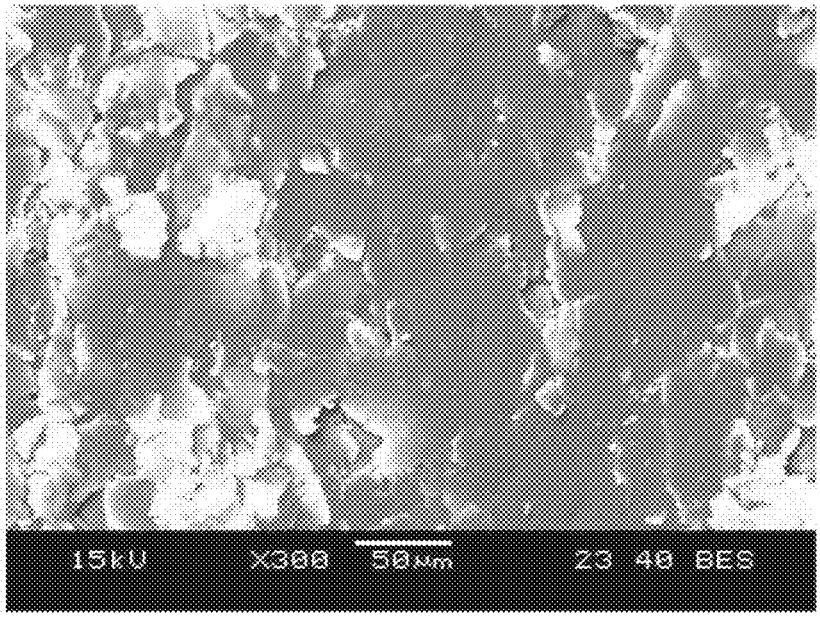
FIG. 7A is an electron micrograph of one surface of the magnetic layer.
Figure 7B:
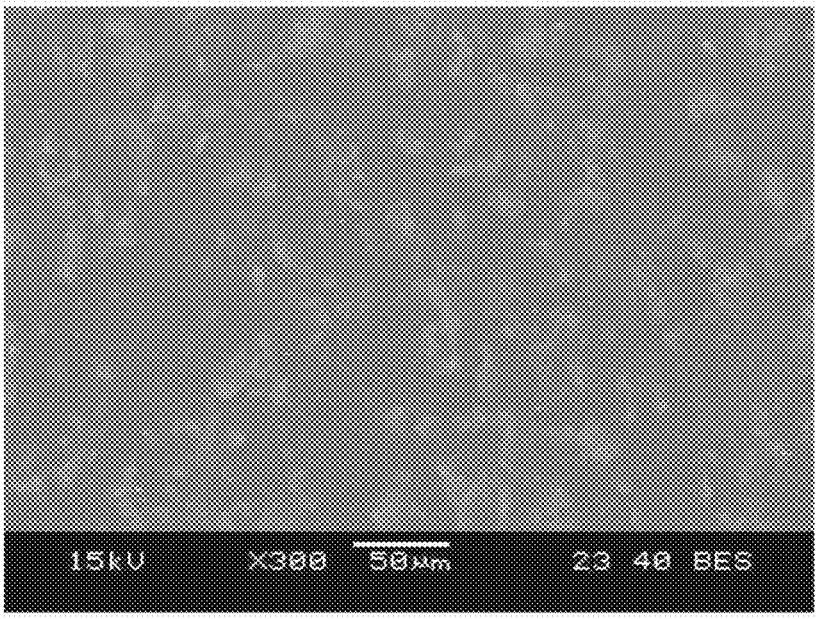
FIG. 7B is an electron micrograph of the other surface of the magnetic layer.

FIGS. 7A and 7B are electron micrographs of the magnetic layer 31 actually manufactured, wherein FIG. 7A is a photograph of the surface 31*a*, and FIG. 7B is a photograph of the surface 31*b*. In these photographs, a dark portion is the binder resin 34, and a white portion is the magnetic powder 35.

As shown in FIG. 7A, it is understood that, in the surface layer part 31A on the side of the surface 31*a*, the density of the magnetic powder 35 is high and the density of the binder resin 34 is low, and thus when the magnetic layer 31 is shot by an electron microscope, a large amount of the magnetic powder 35 is shot white. It is also understood that a large amount of the magnetic powder 35 is exposed on the surface 31*a*. On the other hand, as shown in FIG. 7B, it is understood that in the surface layer part 31B on the side of the surface 31*b*, the density of the magnetic powder 35 is low and the density of the binder resin 34 is high, and thus when the magnetic layer 31 is shot by the electron microscope, it is shot dark across the board. Particularly, there is hardly any magnetic powder 35 exposed on the surface 31*b*.

In this manner, the magnetic layer 31 has such a feature that the density of the binder resin 34 is higher in the surface layer part 31B than in the surface layer part 31A. A manufacturing process of the top plate 30 described later can cause such a difference to be generated between the surface layer parts 31A and 31B.

By utilizing such a difference in surface property, it is possible to impart more favorable characteristics to the coil component 11. For example, when the surface 31*a* is disposed at the lower layer side (resin layer 32 side) and the surface 31*b* at the upper layer side, an insulating property on the upper surface side of the top plate 30 is improved, making it possible to prevent occurrence of a short circuit failure due to contact between the upper surface of the top plate 30 and another electronic component. In addition, the density of the binder resin 34 is low at the surface layer part 31A on the lower surface side of the magnetic layer 31, that is, more magnetic powder 35 exists, so that a magnetic path passing through the top plate 30 is shortened, which makes it possible to obtain high magnetic characteristics.

Conversely, when the surface 31*b* is disposed at the lower layer side (resin layer 32 side) and the surface 31*a* at the upper layer side, dielectric strength between the magnetic layer 31 and terminal electrodes E1 to E4 or wire W is increased. Further, impact resistance and peeling strength are also improved.

While it is not particularly limited thereto, the thickness of the top plate 30 in the z direction is preferably equal to or less than 100 micrometers, more preferably equal to or less than 75 micrometers, and particularly preferably about 60 micrometers. If the thickness of the top plate 30 is equal to or less than 100 micrometers, the height of the entire coil component 11 in the z direction can be set low. When the thickness of the top plate is reduced to 100 micrometers or less while using ferrite, the top plate may be broken due to insufficient strength. However, if the top plate 30 in which the magnetic powder 35 is mixed in the binder resin 34 is used, even if the thickness is reduced to 100 micrometers or less, there will be no breakage. While the lower limit of the thickness of the top plate 30 is not particularly limited to any size, it is preferable that the lower limit is equal to or higher than 30 micrometers. This is because if the thickness of the top plate 30 is reduced to less than 30 micrometers, the strength is not sufficient, and it is difficult to ensure sufficient magnetic properties. To suppress leakage of the magnetic flux sufficiently, it is preferable that the magnetic permeability of the magnetic layer 31 included in the top plate 30 is equal to or higher than 30.

Predetermined flexibility, heat resistance, and strength are required for the binder resin to be used for the magnetic layer 31. The reason the flexibility and the strength are required is that even if the thickness of the top plate 30 is reduced, for example, to 100 micrometers or less, there will be no breakage. The reason the heat resistance is required is that there will be no deformation at the time of reflow. Therefore, a material having high strength but low flexibility, and a material having high flexibility but low heat resistance is not appropriate. Because the reflow temperature is about 260° C., at least binder resin that is not deformed at that temperature needs to be used.

Taking these points into consideration, in the present embodiment, binder resin having a cross-linked structure by urethane bond, with acrylic ester copolymer being amain chain is used. Regarding the composition, although not particularly limited thereto, the acrylic ester copolymer preferably has at least a copolymer structure of ethyl acrylate and a copolymer structure of butyl acrylate. This is for adding the flexibility by the copolymer structure of butyl acrylate, while ensuring high strength by the copolymer structure of ethyl acrylate. It is also preferable that the acrylic ester copolymer further has a copolymer structure of acrylonitrile. This is because the heat resistance and strength are increased by containing the copolymer structure of acrylonitrile.

The top plate 30 can be manufactured according to the following method. First, a binder solution in which a solute containing ethyl acrylate, butyl acrylate, and acrylonitrile having a hydroxyl group or a carboxyl group as a functional group is a main monomer is dissolved in an organic solvent such as methyl ethyl ketone is prepared. A mixed solution is prepared by mixing magnetic powder and a curing agent in the binder solution. As the curing agent, it is preferable to use isocyanate. As the isocyanate, for example, it is preferable to use, for example, aromatic isocyanate or isocyanate containing a triazine ring in the structure, and more preferably, containing a plurality of isocyanate groups in one molecule. Accordingly, the hydroxyl group or the carboxyl group contained as the functional group in the acrylic ester copolymer reacts with isocyanate to form the cross-linked structure. Further, a filler other than the magnetic powder, for example, talc or mica can be further mixed therein.

Figure 8:
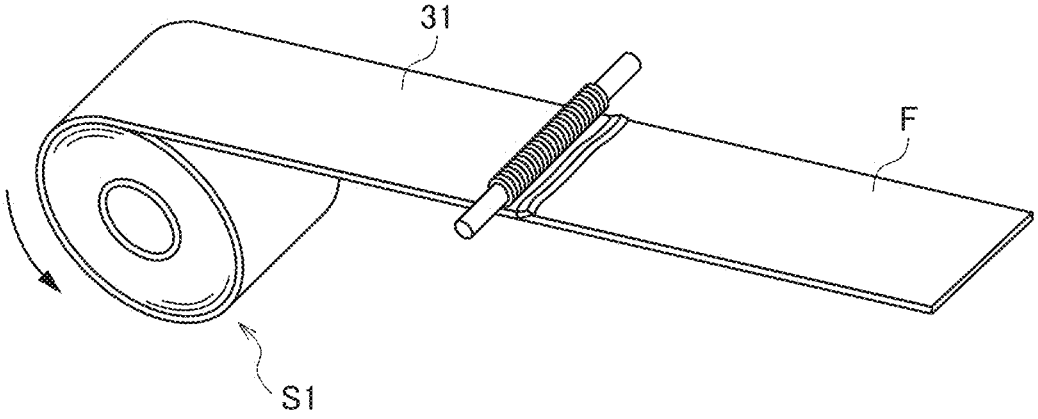
FIG. 8 is an explanatory schematic diagram for explaining a manufacturing method of a sheet in which the magnetic layer is coated on a base film.

As shown in FIG. 8, the mixed solution is applied onto a base film F, the base film F is then wound around a roll while heating the base film F to dry the solvent in the mixed solution and cure the binder resin. The magnetic powder can be oriented in a predetermined direction by applying magnetic field at the time of applying the mixed solution onto the base film F. Accordingly, a sheet S1 in which the magnetic layer 31 made of the magnetic-powder containing resin is applied onto the surface of the base film F is obtained. As the base film F, a PET film can be used. It is preferable that a content ratio of the magnetic powder in the cured magnetic-powder containing resin is from 50% to 90% by weight. If the content ratio of the magnetic powder is less than 50% by weight, sufficient magnetic permeability cannot be obtained, and if the content ratio thereof exceeds 90% by weight, the possibility that the magnetic powder falls off from a cut surface of the top plate 30 increases.

When the magnetic layer 31 made of the magnetic-powder containing resin is applied onto the surface of the base film F, characteristics of the magnetic layer 31 are slightly different in the surface layer part on the base film F side and in the surface layer part on an exposed side opposite thereto. It is considered this is due to the surface tension of the binder resin, which is uncured. The density of the magnetic powder 35 becomes low in the surface layer part 31B on the base film F side and becomes high in the surface layer part 31A on the exposed side.

Figure 9:
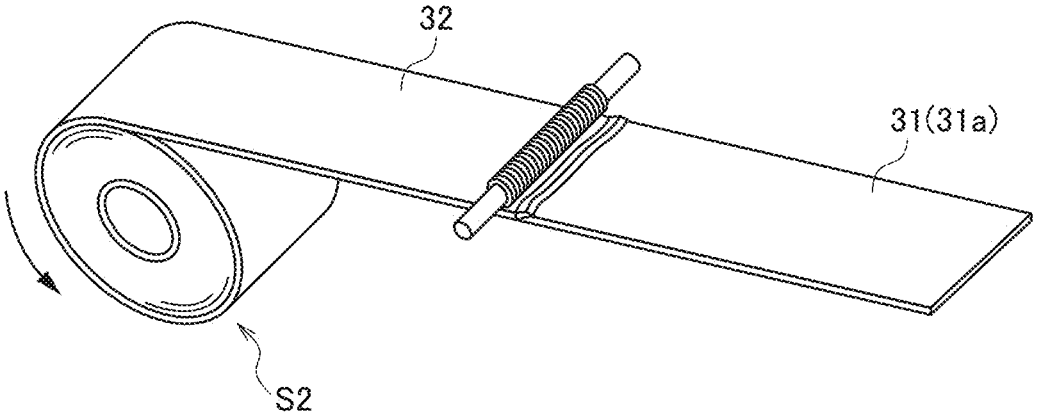
FIG. 9 is an explanatory schematic diagram for explaining a manufacturing method of a sheet in which the resin layer is coated on the magnetic layer.

Then, the magnetic layer 31 is peeled off from the base film F, and then, as illustrated in FIG. 9, a resin material constituting the resin layer 32 is applied onto the surface 31*a* positioned on the side opposite to the base film F, followed by rolling up while thermal curing is performed. As a result, a sheet S2 in which the resin layer 32 is applied onto the surface of the magnetic layer 31 is obtained.

Figure 10A:
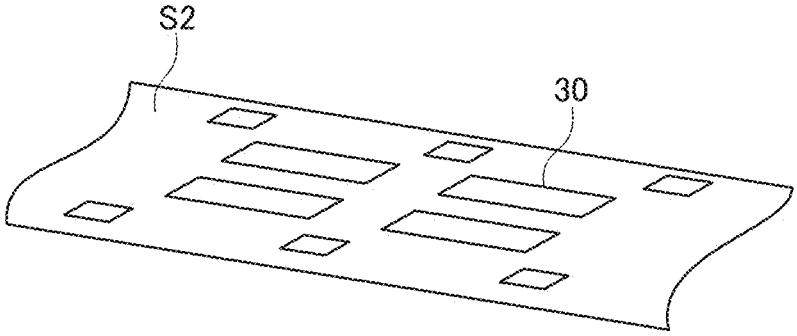
FIGS. 10A to 10C are process diagrams for explaining a manufacturing method of the coil component.
Figure 10B:
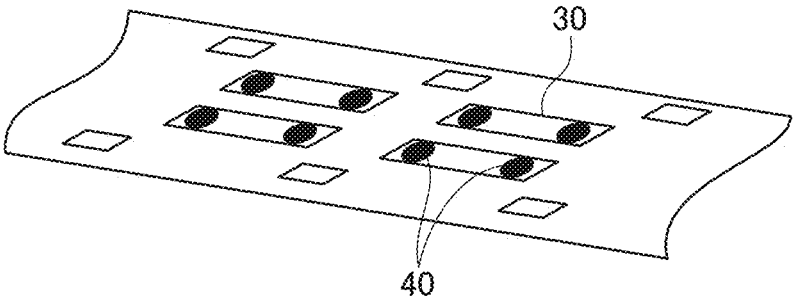
Figure 10C:
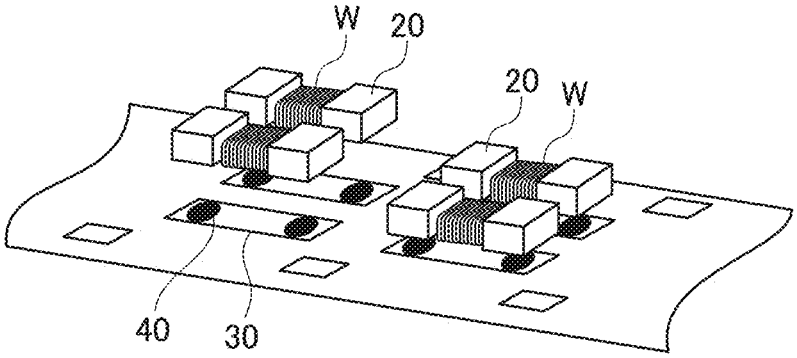

Then, as illustrated in FIG. 10A, the sheet S2 is stamped into a planar shape corresponding to the top plate 30 using a die. Then, an epoxy-based adhesive 40 is applied onto the stamped portion as illustrated in FIG. 10B, and then the drum core 20 around which the wire W is wound is bonded to the stamped portion, as illustrated in FIG. 10C. Then, the drum core 20 to which the top plate 30 is bonded is separated from the sheet body, whereby the coil component 11 of the present embodiment is accomplished.

By manufacturing the coil component 11 using the above method, the top plate 30 can be bonded to the drum core 20 with the surface of the magnetic powder-containing resin directed to the base film F side during the adhesive application, i.e., the surface 31*b* of the magnetic layer 31 at the side where the density of the binder resin 34 is higher, as the upper surface. The resin layer 32 may be formed without peeling off the magnetic layer 31 from the base film F. In this case, the base film F may be peeled off after completion of the process illustrated in FIG. 10C.

On the other hand, when the top plate 30 can be bonded to the drum core 20 with the surface 31*a* of the magnetic layer 31 at the side where the density of the binder resin 34 is lower, as the upper surface, the base film F itself can be used as the resin layer. This can reduce the number of application processes to one, making it possible to reduce the manufacturing cost. However, in this case, as a material for the base film F, it is necessary to use not the PET resin, but a resin material having higher heat resistance.

Second Embodiment

Figure 11:
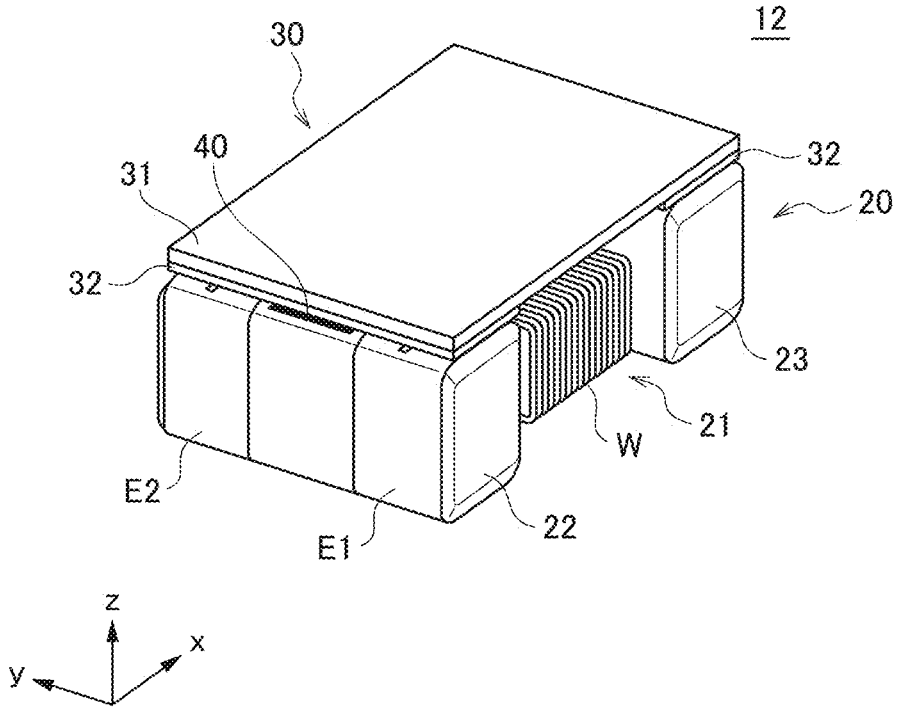
FIG. 11 is a perspective view of a coil component according to a second embodiment of the present invention when an upper surface thereof is viewed from an oblique direction.
Figure 12:
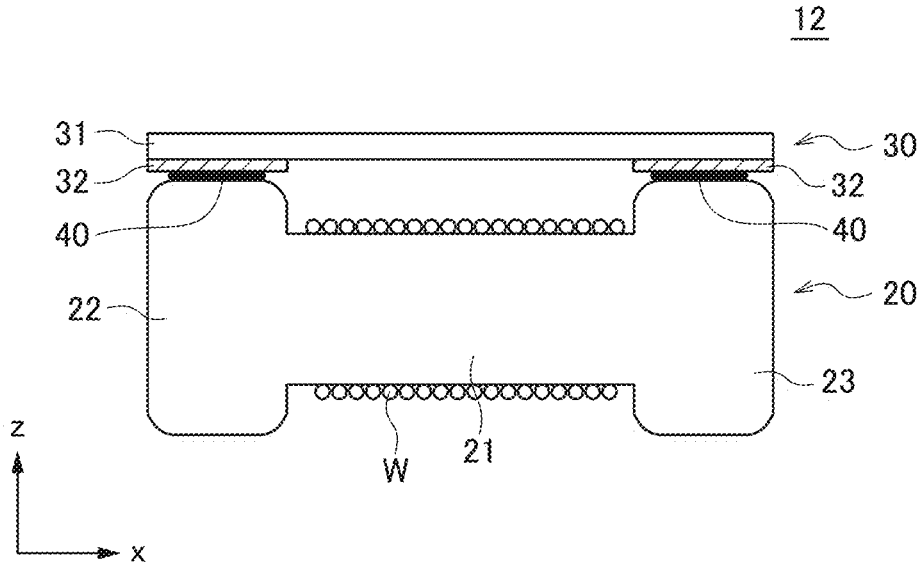
FIG. 12 is a sectional view of the coil component according to the second embodiment of the present invention.

FIGS. 11 and 12 are views each illustrating the configuration of a coil component 12 according to the second embodiment of the present invention. FIG. 11 is a perspective view as viewed obliquely from above, and FIG. 12 is a cross-sectional view.

As illustrated in FIGS. 11 and 12, the coil component 12 according to the second embodiment of the present invention differs from the above-described coil component 11 according to the first embodiment in that the resin layer 32 is selectively provided between the flange parts 22, 23 and the magnetic layer 31. That is, the resin layer 32 is divided to two parts in a plan view. Other configurations are the same as those of the coil component 11 according to the first embodiment, so the same reference numerals are given to the same elements, and overlapping description will be omitted.

According to the present embodiment, the resin layer 32 is thus divided into two parts, so that even if there is a comparatively large difference between the thermal expansion coefficient of the resin layer 32 and that of the drum core 20, the top plate 30 is unlikely to be peeled off. In the example illustrated in FIGS. 11 and 12, the planar sizes of the resin layer 32 and the flange parts 22, 23 substantially coincide with each other; however, it is sufficient that at least the resin layer 32 is interposed between a part of the flange part 22 and the magnetic layer 31 and between a part of the flange part 23 and the magnetic layer 31. However, to ensure dielectric strength and impact resistance more reliably, it is preferable to completely cover the surfaces of the flange parts 22 and 23 in a plan view (as viewed in the z-direction) with the resin layer 32.

The coil component 12 according to the present embodiment is preferably manufactured by bonding the resin layer 32 previously cut into a predetermined size to the upper surfaces of the flange parts 22 and 23 and then bonding the magnetic layer 31. With this method, positioning of the resin layer 32 can be performed more easily than a method in which the resin layer 32 is bonded to the magnetic layer 31.

It is apparent that the present invention is not limited to the above embodiments, but may be modified and changed without departing from the scope and spirit of the invention.

What is claimed is:

1. A coil component comprising:

a drum core having a winding core part and first and second flange parts provided on both sides of the winding core part;

a wire wound around the winding core part;

a plurality of terminal electrodes connected with end portions of the wire, each of the terminal electrodes being provided on an associated one of the first and second flange parts; and a top plate fixed to the first and second flange parts, wherein the top plate includes:

a magnetic layer comprising magnetic powder and binder resin; and a resin layer having a smaller content of the magnetic powder than that of the magnetic layer, and wherein the resin layer is positioned between the first and second flange parts and the magnetic layer, wherein the magnetic layer of the top plate has a lower surface facing the resin layer and an upper surface positioned on an opposite side to the lower surface, and wherein a density of the binder resin is higher at a surface layer part on the upper surface side than at a surface layer part on the lower surface side.

2. The coil component as claimed in claim 1, wherein the resin layer is substantially free from the magnetic powder.

3. The coil component as claimed in claim 1, wherein the resin layer includes non-magnetic filler.

4. The coil component as claimed in claim 1, wherein the resin layer covers an entire surface of the magnetic layer.

5. The coil component as claimed in claim 1, wherein the resin layer is selectively provided between the first and second flange parts and the magnetic layer.

6. The coil component as claimed in claim 1, further comprising an adhesive for bonding the first and second flange parts and the resin layer of the top plate.

7. The coil component as claimed in claim 1, wherein the magnetic powder is soft magnetic metal powder.

8. The coil component as claimed in claim 7, wherein the soft magnetic metal powder has a flat shape.

9. The coil component as claimed in claim 1, wherein the resin layer having a thermal expansion coefficient falling between a thermal expansion coefficient of the magnetic layer and a thermal expansion coefficient of the drum core.

10. A coil component comprising:

a drum core having a winding core part extending in an axial direction, a first flange part provided on one end of the winding core part in the axial direction, and a second flange part provided on other end of the winding core part in the axial direction;

a first terminal electrode provided on the first flange part;

a second terminal electrode provided on the second flange part;

a wire wound around the winding core part, the wire having a first end connected to the first terminal electrode and a second end connected to the second terminal electrode;

a first layer fixed to the first and second flange parts; and a second layer covering the first and second flange parts with an intervention of the first layer, wherein the second layer includes magnetic powder and binder resin while the first layer is substantially free from magnetic powder, wherein the second layer has a lower surface facing the first layer and an upper surface positioned an opposite side to the lower surface, and wherein a density of the binder resin is higher at a surface layer part on the upper surface side than at a surface layer part on the lower surface side.

11. The coil component as claimed in claim 10, wherein the first layer contacts the first and second terminal electrodes or the first and second ends of the wire.

12. The coil component as claimed in claim 10, wherein the second layer is thicker than the first layer.

13. The coil component as claimed in claim 10, wherein the first layer having a thermal expansion coefficient falling between a thermal expansion coefficient of the second layer and a thermal expansion coefficient of the drum core.

14. A coil component comprising:

a drum core having a winding core part extending in an axial direction, a first flange part provided on one end of the winding core part in the axial direction, and a second flange part provided on other end of the winding core part in the axial direction;

a first terminal electrode provided on the first flange part;

a second terminal electrode provided on the second flange part;

a wire wound around the winding core part, the wire having a first end connected to the first terminal electrode and a second end connected to the second terminal electrode;

a first layer fixed to the first and second flange parts; and a second layer covering the first and second flange parts with an intervention of the first layer and including magnetic powder and binder resin, wherein the first layer having a thermal expansion coefficient falling between a thermal expansion coefficient of the second layer and a thermal expansion coefficient of the drum core, wherein the second layer has a lower surface facing the first layer and an upper surface positioned an opposite side to the lower surface, and wherein a density of the binder resin is higher at a surface layer part on the upper surface side than at a surface layer part on the lower surface side.

* * * * *